US011731817B2

(12) United States Patent
Sparrow et al.

(10) Patent No.: US 11,731,817 B2
(45) Date of Patent: Aug. 22, 2023

(54) MODULAR PACKAGING CONTAINER SYSTEM

(71) Applicant: Poésie LLC, Pleasanton, CA (US)

(72) Inventors: Anastasia Sparrow, Belvedere, CA (US); Peter James Palmer, Pleasanton, CA (US); Christopher George Palmer, Pleasanton, CA (US); Mattias Sparrow, Belvedere, CA (US)

(73) Assignee: POÉSIE LLC, Pleasanton, CA (US)

( * ) Notice: Subject to any disclaimer, the term of this patent is extended or adjusted under 35 U.S.C. 154(b) by 0 days.

(21) Appl. No.: 17/973,760

(22) Filed: Oct. 26, 2022

(65) Prior Publication Data

US 2023/0137961 A1 May 4, 2023

Related U.S. Application Data

(60) Provisional application No. 63/274,590, filed on Nov. 2, 2021.

(51) Int. Cl.

| | |
|---|---|
| ***B65D 51/24*** | (2006.01) |
| ***B65D 65/46*** | (2006.01) |
| ***B65D 25/04*** | (2006.01) |
| *B65D 77/00* | (2006.01) |

(52) U.S. Cl.

CPC ..... *B65D 51/249* (2013.01); *B65D 25/04* (2013.01); *B65D 65/466* (2013.01); *B65D 77/006* (2013.01); *B65D 2313/04* (2013.01); *B65D 2565/382* (2013.01)

(58) Field of Classification Search

CPC ..... B65D 2313/04; B65D 5/5253; B65D 77/006; A45D 2200/05

USPC ..... 206/45.25, 755, 581, 823, 472, 450

See application file for complete search history.

(56) References Cited

U.S. PATENT DOCUMENTS

| | | | | |
|---|---|---|---|---|
| 9,382,033 | B2 * | 7/2016 | Poon | B65D 5/5206 |
| 9,521,226 | B2 * | 12/2016 | Ashley | G06F 1/1626 |
| 9,851,748 | B2 * | 12/2017 | Senatori | G06F 1/1679 |
| 10,671,121 | B2 * | 6/2020 | Zhu | H01R 13/6633 |
| 10,882,661 | B1 * | 1/2021 | Seidler | B65D 21/083 |
| 11,307,615 | B2 * | 4/2022 | Zimmerman | G06F 1/1632 |

(Continued)

OTHER PUBLICATIONS

Zagg, disclosed in a YouTube video from DAMR: https://www.youtube.com/watch?v=7sD9ljoZ2FE available since Jan. 3, 2021, and YouTube video from ZAGGTV YouTube channel: https://www.youtube.com/watch?v=9HcB2DxC6S4 available since Oct. 21, 2020, 2. (Year: 2020).*

(Continued)

*Primary Examiner* — Mollie Impink

(74) *Attorney, Agent, or Firm* — Flener IP & Business Law; Zareefa B. Flener; Ayhan E. Mertogul

(57) ABSTRACT

A modular packaging container system includes a cover having a hinge portion connected between a top portion and a base portion along first and second fold lines, respectively, the base portion further including a support portion connected to an easel portion by a third fold line. The support portion includes first and second magnets embedded therein, each adapted to detachably attach at least one receptacle tray to the support portion, wherein the first magnet is disposed between the second magnet and an edge of the support portion opposite the third fold line.

8 Claims, 8 Drawing Sheets

(56) References Cited

U.S. PATENT DOCUMENTS

| | | | | |
|---|---|---|---|---|
| 2012/0037523 | A1* | 2/2012 | Diebel | A45C 13/005 206/320 |
| 2014/0291176 | A1* | 10/2014 | Chung | G06F 1/1626 206/45.23 |
| 2014/0299151 | A1* | 10/2014 | Stroud | A45D 33/008 132/315 |
| 2016/0233911 | A1* | 8/2016 | Sirichai | G06F 1/182 |
| 2021/0067862 | A1* | 3/2021 | Li | H04R 1/023 |
| 2021/0078784 | A1* | 3/2021 | Huang | B65D 77/0413 |

OTHER PUBLICATIONS

Pela https://a.co/d/5O8yKO3 (Year: 2020) Amazoncom Pela Phone Case for iPhone 11 Pro—Eco-Friendly—Made from Plants (1.*

* cited by examiner

MODULAR PACKAGING CONTAINER SYSTEM

CROSS-REFERENCE TO RELATED APPLICATIONS

This application claims the benefit of priority to U.S. Provisional Patent Application No. 63/274,590 filed on Nov. 1, 2021, and incorporated in its entirety by reference herein.

FIELD OF THE INVENTION

The present invention relates generally to a modular packaging container system. In particular, the present invention relates to a modular packaging container system that is biodegradable and can be held in one hand or is self-supported when placed on a surface.

BACKGROUND

The cosmetics and skincare industry has an enormous impact on the environment. Packaging is the number one contributor to plastic production in the world and the number one offender for plastic waste pollution. As of 2015 packaging accounted for over 150 million tons of plastic every year of which 11 million tons leak into the ocean. Although there has been minimal scrutiny and oversight and therefore little hard data on the environmental impact of cosmetics packaging, it is estimated that the beauty industry creates 120 billion units of packaging every year. The reliance on heavy use of plastics and petroleum-based chemicals can not only take thousands of years to degrade in landfills, but harmful toxins can also leech into the soils and waterways, potentially impacting environments far away from localized disposal sites. While advancements in "clean" cosmetics have been useful at helping to begin mitigating negative effects on human health at a use case level, cosmetics packaging remains one of the largest contributors to global environmental pollution and ecological degradation.

Many existing paper based cosmetic packages utilize a simple book style containment that is familiar, easily produced, and provides the user easy access to the cosmetic product. Book style packaging efficiently stores components and protects and isolates them from their surroundings, especially important for makeup (such as eye shadows, foundations, and lip cosmetics) as the user may travel with the packaging or use it in a variety of environments. Book style packaging in its popular form also allows the user to hold the packaging in one hand while accessing and using the interior components with the other hand. While book style functional design has been utilized for hundreds of years, it has significant ergonomic deficiencies, for example, it requires complex and unsteady physical manipulation within the hand to allow simple access to all areas of the internal components. Solutions to this challenge include purposefully making the packaging (a) oversized to eliminate grabbing and damaging internal components with finger and thumb or (b) to be placed on a stand or fixture, table or similar to improve functionality of use.

A need therefore exists for a container system having a comparatively positive impact on the environment while providing consumers with enhanced functionality, reusability, flexibility, aesthetics, and design features. It would be beneficial for the container system to be modular and have multi-functional usage built into its design to solve existing ergonomic issues. It would also be beneficial for the container system to have a built-in stand, easel or fixture, and further to be at least partially biodegradable. It would be further beneficial if a portion of the container system was durable and reusable with other portions that could be used and discarded as needed.

SUMMARY OF THE INVENTION

In one aspect of the invention, a modular packaging container system comprises a cover comprising a hinge portion connected between a top portion and a base portion along first and second fold lines, respectively, the base portion further comprising a support portion connected to an easel portion by a third fold line. The support portion comprises first and second magnets embedded therein, each adapted to detachably attach at least one receptacle tray to the support portion, wherein the first magnet is disposed between the second magnet and an edge of the support portion opposite the third fold line.

In another aspect of the invention, a modular packaging container system comprises a cover comprising a hinge portion connected between a top portion and a base portion along first and second fold lines, respectively, the base portion further comprising a support portion connected to an easel portion by a third fold line. The support portion comprises first and second magnets embedded therein, each adapted to detachably attach at least one receptacle tray to the support portion, wherein the first magnet is disposed between the second magnet and an edge of the support portion opposite the third fold line. A first surface of the top portion further comprises an easel docking groove oriented parallel to the third fold line. In a first configuration the hinge portion, the top portion, and the base portion are all arranged within a common plane, and in a second configuration the top portion is folded along the first fold line in a first direction away from the common plane and the third fold line is disposed away from the common plane in the first direction while the hinge portion remains in the same position as in the first configuration.

In a further aspect of the invention, a modular packaging container system comprises a cover comprising a hinge portion connected between a top portion and a base portion along first and second fold lines, respectively, the base portion further comprising a support portion connected to an easel portion by a third fold line. The modular packaging container system further comprises at least one receptacle tray, wherein the support portion comprises first and second magnets embedded therein, each adapted to detachably attach the at least one receptacle tray to the support portion, wherein the first magnet is disposed between the second magnet and an edge of the support portion opposite the third fold line. A first surface of the top portion further comprises an easel docking groove oriented parallel to the third fold line. In a first configuration the hinge portion, the top portion, and the base portion are all arranged within a common plane, and in a second configuration the top portion is folded along the first fold line in a first direction away from the common plane and the third fold line is disposed away from the common plane in the first direction while the hinge portion remains in the same position as in the first configuration.

Additional aspects and advantages of the present disclosure will become readily apparent to those skilled in this art from the following detailed description, wherein only illustrative embodiments of the present disclosure are shown and described.

BRIEF DESCRIPTION OF THE DRAWINGS

Other aspects and advantages of the present invention will become apparent upon consideration of the following detailed description, wherein similar structures have similar reference numerals.

DETAILED DESCRIPTION

Figure 1:
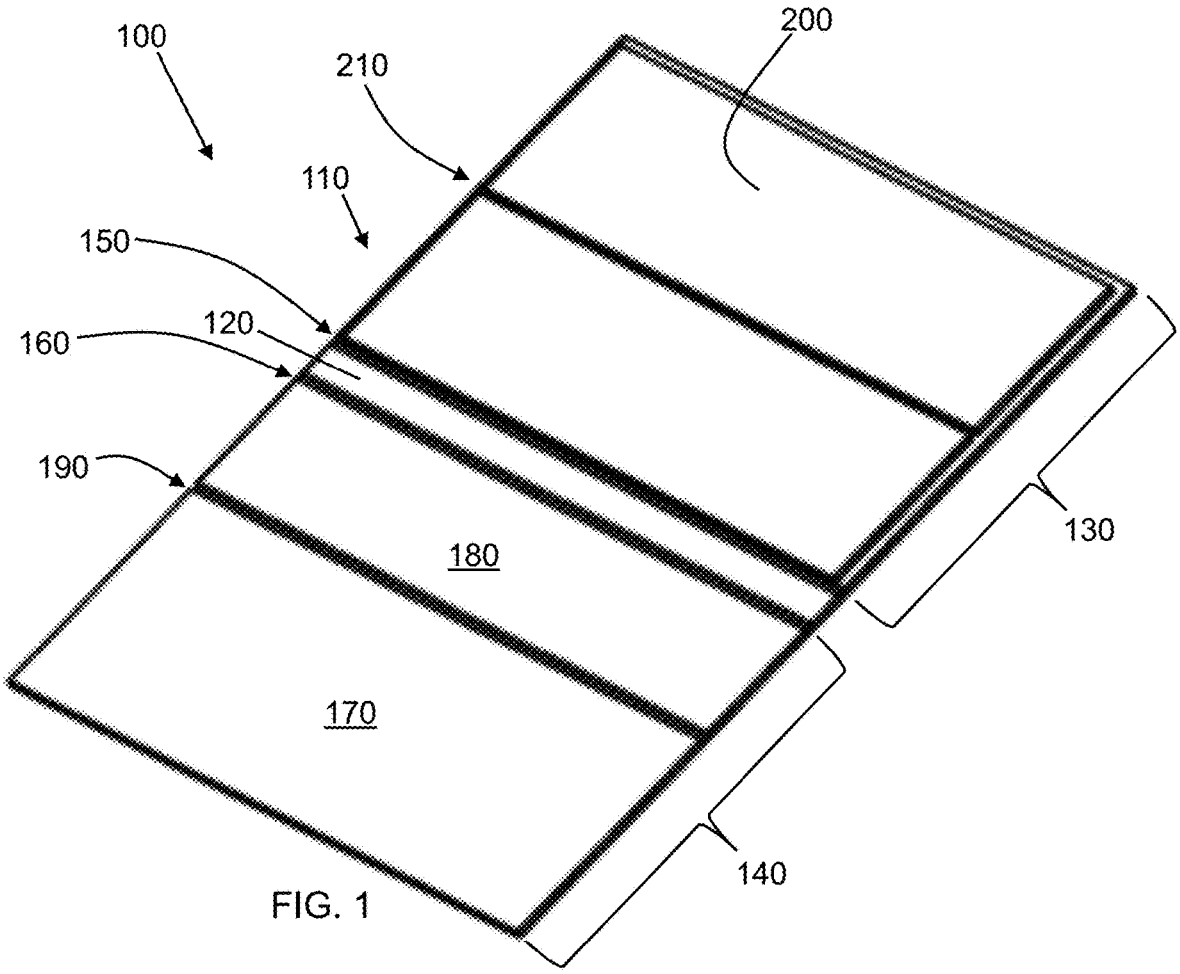
FIG. 1 illustrates a perspective view of an exemplary cover for a modular packaging container system according to an embodiment, the exemplary cover illustrated in a first configuration.

The following detailed embodiments presented herein are for illustrative purposes. That is, these detailed embodiments are intended to be exemplary of the present invention for the purposes of providing and aiding a person skilled in the pertinent art to readily understand how to make and use of the present invention. In the descriptions that follow identical reference numerals used to describe components of different disclosed embodiments refer to identical components that may be part of the different disclosed embodiments.

Referring to FIG. 1, in an embodiment a modular packaging container system (MPCS) 100 comprises a cover 110 comprising a hinge portion 120 connected between a top portion 130 and a base portion 140 along first 150 and second 160 fold lines, respectively. In an embodiment the base portion 140 further comprises a support portion 170 connected to an easel portion 180 by a third fold line 190. In an embodiment, a first surface 200 of the top portion 130 further comprises an easel docking groove 210 oriented parallel to the third fold line 190.

Figure 2:
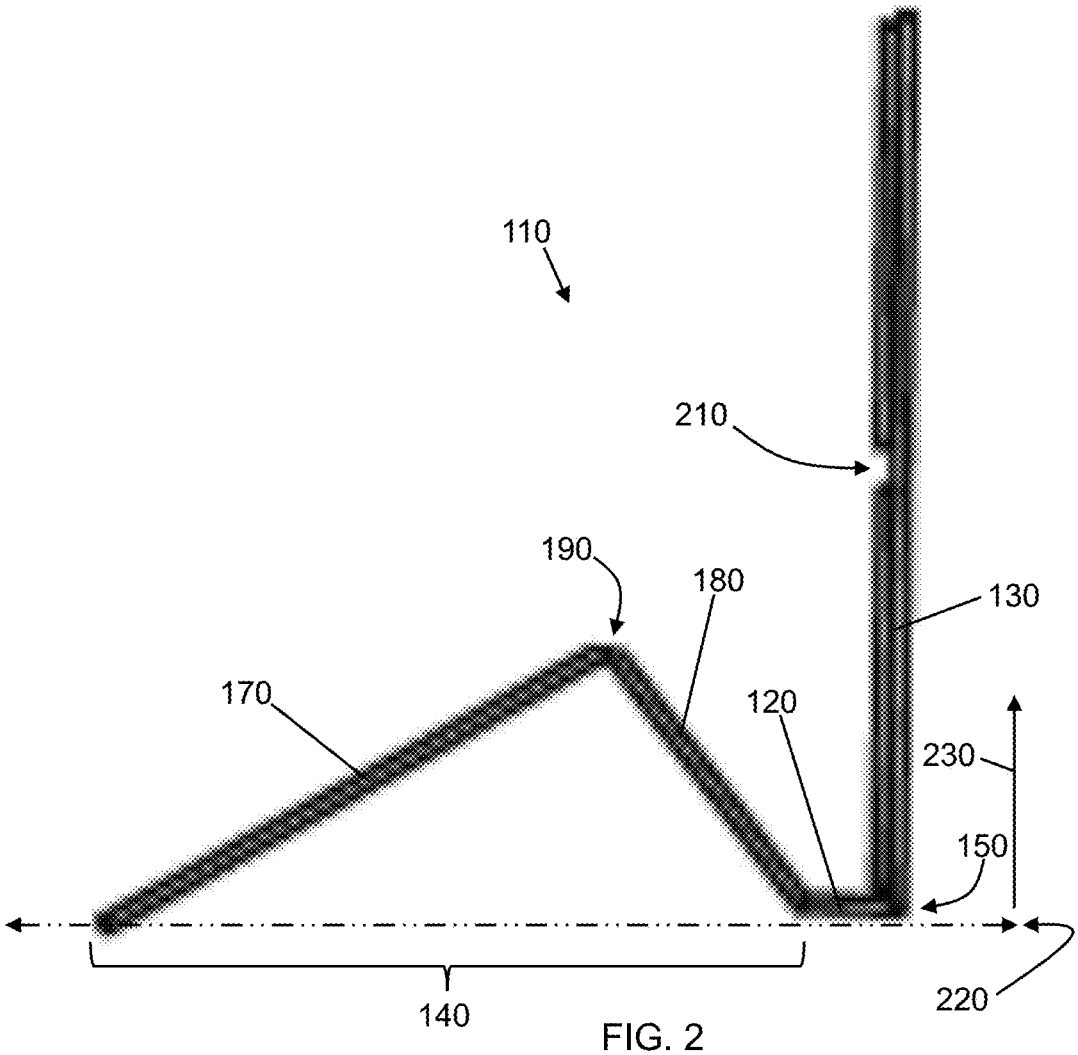
FIG. 2 illustrates a side view of the exemplary cover according to an embodiment, the exemplary cover illustrated in a second configuration.

Still referring to FIG. 1, in a first configuration the hinge portion 120, the top portion 130, and the base portion 140 are all arranged within a common plane 220 (see FIG. 2). In a second configuration, as illustrated in FIG. 2, the top portion 130 is folded along the first fold line 150 in a first direction 230 away from the common plane 220 and the third fold line 190 is disposed away from the common plane 220 in the first direction 230 while the hinge portion 120 remains in the same position as in the first configuration.

Figure 3:
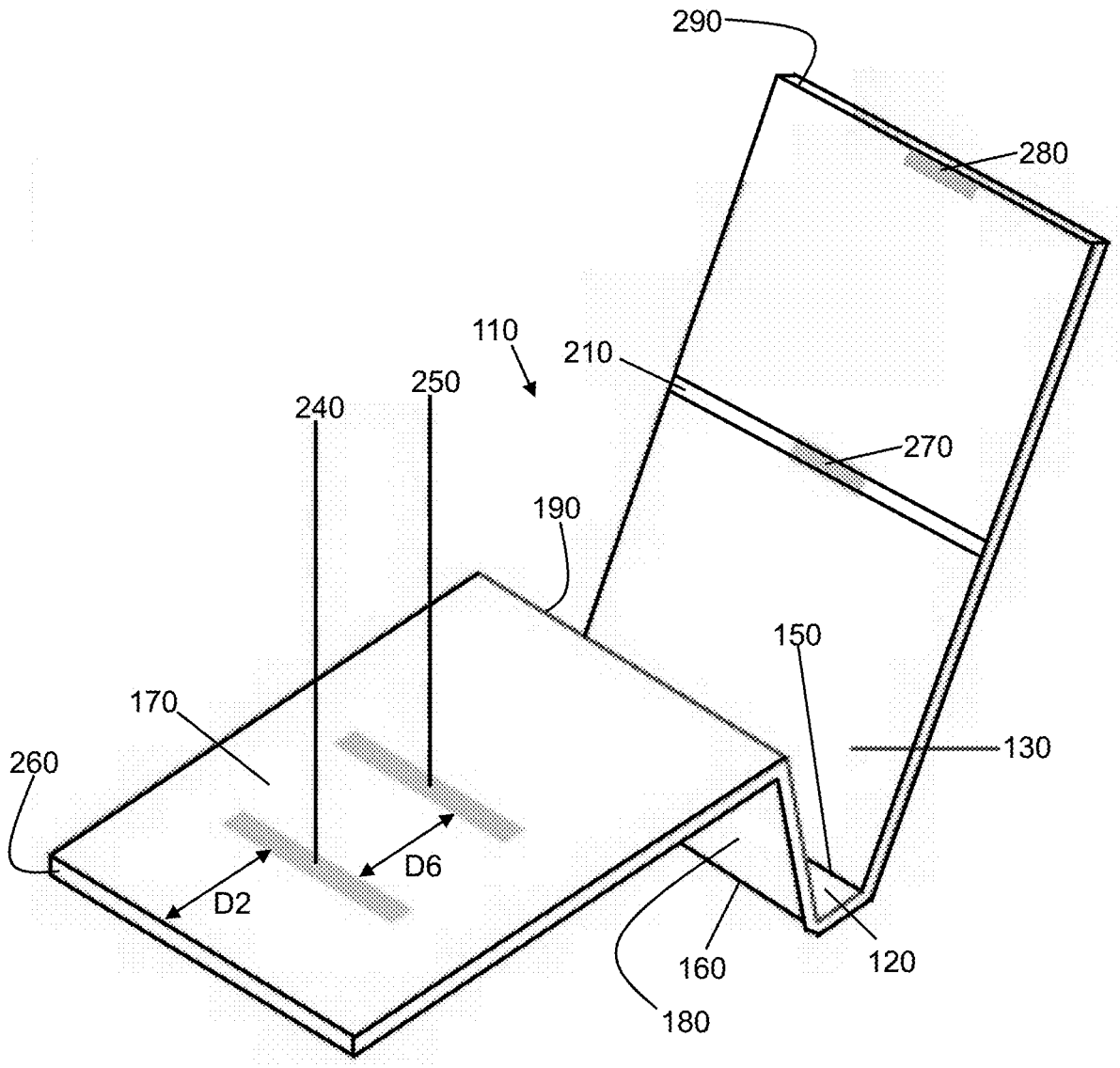
FIG. 3 illustrates a perspective view of the exemplary cover in the second configuration according to an embodiment.

Referring to FIG. 3, which also illustrates the cover 110 in the second configuration, the support portion 170 in an embodiment comprises first 240 and second 250 magnets embedded therein. In an embodiment each of the first 240 and second 250 magnets is adapted to detachably attach at least one receptacle tray (see FIGS. 4-6) to the support portion 170, wherein the first magnet 240 is disposed between the second magnet 250 and an edge 260 of the support portion 170 opposite the third fold line 190. In an embodiment the top portion 130 further comprises a magnet 270 embedded therein proximate to the easel docking groove 210. In an embodiment the top portion 130 further comprises a magnet 280 embedded therein and disposed along an edge 290 of the top portion 130 opposite the first fold line 150.

Figure 4:
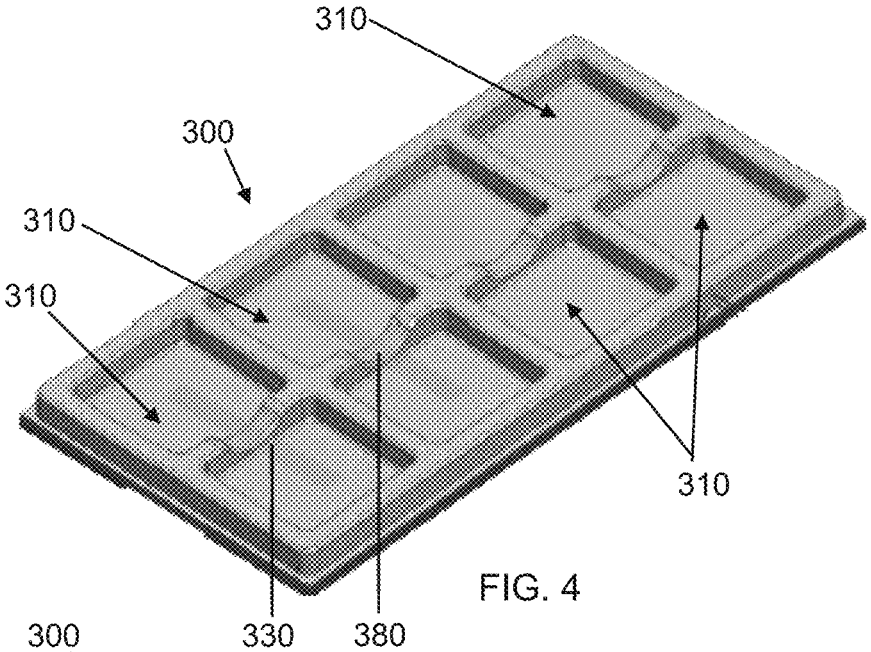
FIG. 4 illustrates a perspective view of an exemplary receptacle tray according to an embodiment.
Figure 5:
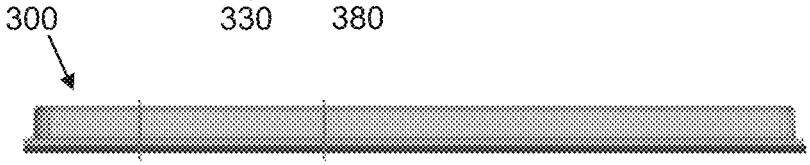
FIG. 5 illustrates a side view of the exemplary receptacle tray of FIG. 4.
Figure 6:
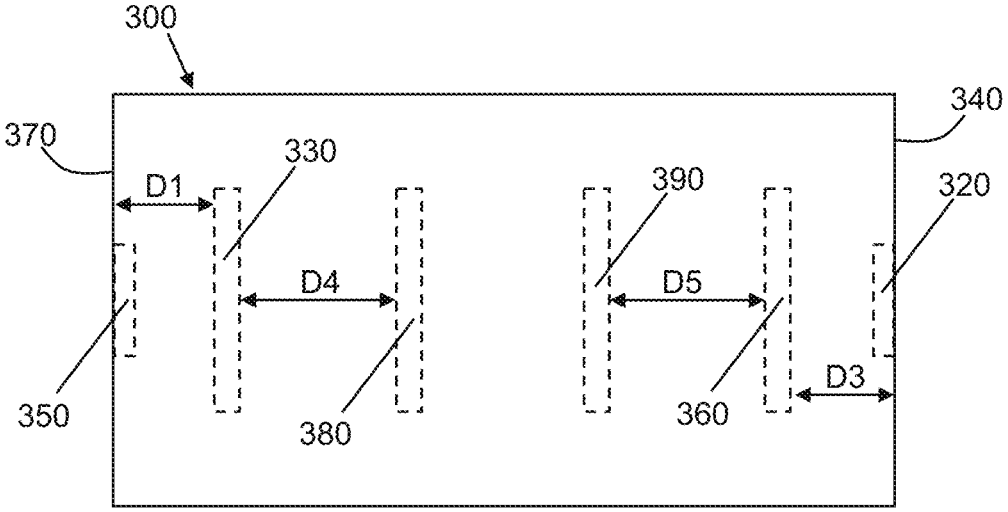
FIG. 6 illustrates a bottom view of the exemplary receptacle tray of FIG. 4.
Figure 7:
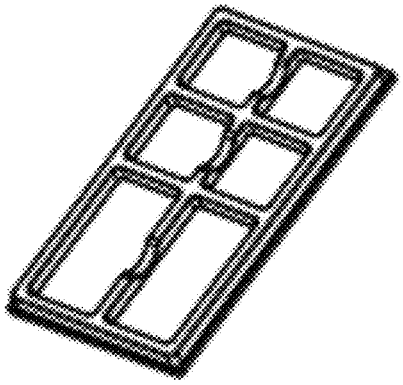
FIG. 7 illustrates a perspective view of an exemplary receptacle tray according to another embodiment.
Figure 8:
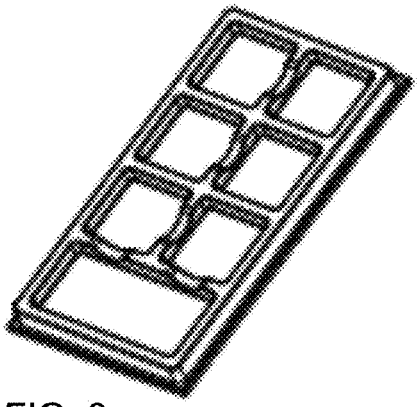
FIG. 8 illustrates a perspective view of an exemplary receptacle tray according to a further embodiment.
Figure 9:
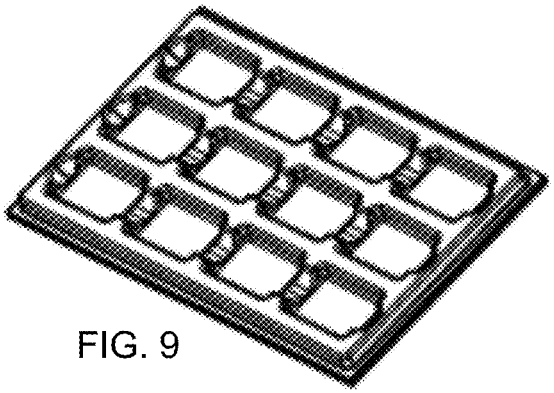
FIG. 9 illustrates a perspective view of an exemplary receptacle tray according to yet another embodiment.
Figure 10:
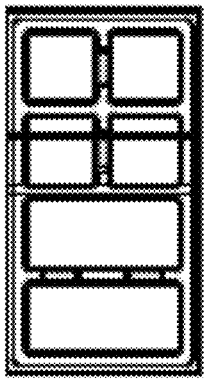
FIG. 10 illustrates a top plan view of an exemplary receptacle tray according to yet another embodiment.
Figure 11:
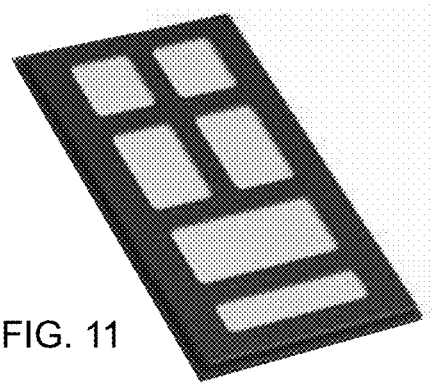
FIG. 11 illustrates a perspective view of an exemplary receptacle tray according to yet a further embodiment.

Referring to FIGS. 4-6, in an embodiment the MPCS 100 comprises at least one receptacle tray 300 that is adapted to detachably attach to the support portion 170. In an embodiment the at least one receptacle tray 300 is adapted to contain consumable items, for example, without limitation, cosmetic powders and creams. In an embodiment the at least one receptacle tray 300 comprises one or more recesses 310 to accommodate consumable material or items or small containers containing consumable material or items. In an embodiment the at least one receptacle tray 300 includes 8 uniformly sized recesses 310 as shown in FIG. 4; however, in other embodiments the receptacle tray 300 includes 1 to 7 or 9 to 100 or more recesses that may be uniformly or differently sized, and arranged in a rectangular array or a circular array or any other sort of relative arrangement. The possible configurations for the number, sizes, and arrangement of recesses possible in the receptacle tray are too many to illustrate herein; however, some exemplary non-limiting examples are provided in FIGS. 7-11.

FIG. 6 illustrates a side of an exemplary at least one receptacle tray 300 opposite to the side having the recesses 310. In an embodiment the at least one receptacle tray 300 comprises at least two magnets 320, 330 embedded therein, wherein the magnet 320 is disposed along a first edge 340 of the at least one receptacle tray 300 and the magnet 330 is spaced away from the magnet 320. In an embodiment the magnet 330 is spaced by a distance D1 from a second edge 350 of the receptacle tray 300 opposite the first edge 340, and in an embodiment the distance D1 matches a distance D2 between the first magnet 240 and the edge 260 of the support portion 170 (see FIG. 3).

Still referring to FIG. 6, in an embodiment the at least one receptacle tray 300 further comprises two more magnets 350, 360 embedded therein, wherein the magnet 350 is disposed along a second edge 370 of the at least one receptacle tray 300 opposite the first edge 340 and the magnet 360 is disposed between the magnet 320 and the magnet 330. In an embodiment the magnet 360 is spaced by a distance D3 from the edge 340 of the receptacle tray 300, and in an embodiment the distance D3 matches the distance D2 between the first magnet 240 and the edge 260 of the support portion 170 (see FIG. 3).

In an embodiment the at least one receptacle tray 300 further comprises two more magnets 380, 390 embedded therein, wherein the magnet 380 is disposed between the magnet 330 and the magnet 360, and the magnet 390 is disposed between the magnet 360 and the magnet 380. In an embodiment the magnet 380 is spaced by a distance D4 from the magnet 330, and the magnet 390 is spaced by a distance D5 from the magnet 360, and in an embodiment the distances D4 and D5 match the distance D6 between the first magnet 240 and the second magnet 250 of the support portion 170 (see FIG. 3).

Although illustrated as dashed lines in FIG. 6 to be representative of being just below the surface of the at least one receptacle tray 300, in an embodiment all of the magnets 320, 330, 350, 360, 380, and 390 embedded in the at least one receptacle tray 300 are embedded at or just below the surface. Similarly, in an embodiment all of the magnets 240, 250, 270, and 280 embedded in the cover 110 are embedded at or just below the surface.

Figure 12:
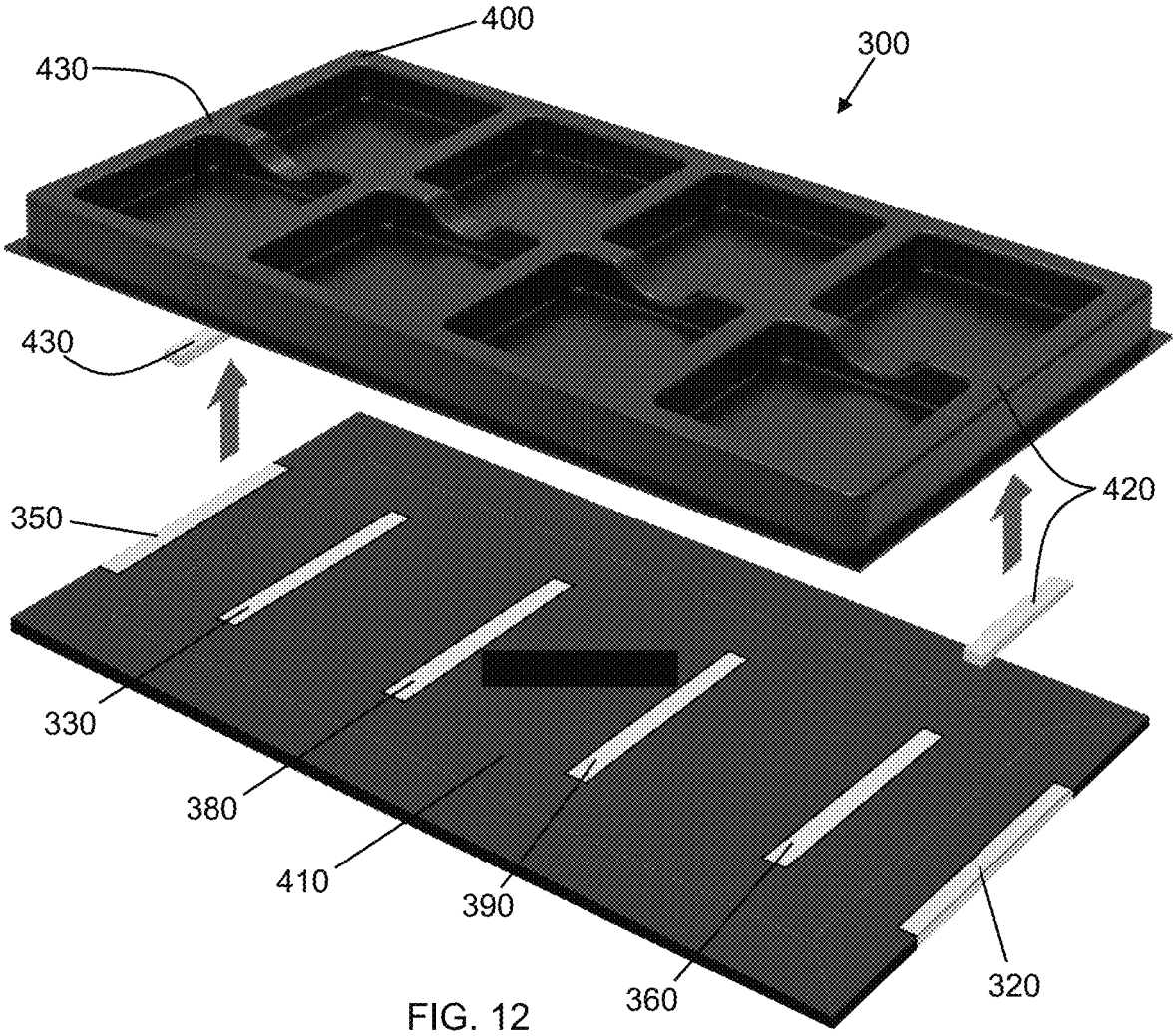
FIG. 12 illustrates a perspective view of an exemplary receptacle tray having a tray portion separable from a board portion according to an embodiment.

Referring to FIG. 12, in an embodiment the at least one receptacle tray 300 comprises a tray portion 400 separable from a board portion 410. The board portion 410 is illustrated in FIG. 12 as having the arrangement of magnets 320, 330, 350, 360, 380, and 390 described above again at or just below the surface of the board portion 410. In an embodiment the tray portion 400 further includes magnets 420 and 430, each shown in solid lines separated from the tray portion 400 and as dashed lines embedded within the tray portion 400. In an embodiment the magnets 420, 430 are positioned at opposite ends of the tray portion 400 so as to be aligned with the magnets 320 and 350, respectively, in the board portion 410 to allow for a detachable magnetic attachment between the tray portion 400 and board portion 410. An embodiment having separable tray 400 and board 410 portions as shown in FIG. 12 allows a single board portion 410 to be used with a plurality of tray portions 400 that can have any desired configuration for the recesses 310.

In an embodiment as further described hereinbelow, the at least one receptacle tray 300 is adapted to detachably attach to the cover 110 via magnetic attraction between one or more of the magnets 320, 330, 350, 360, 380, and 390 embedded in the board portion 410 as described above and one or more of the magnets 240, 250, 270, and 280 embedded in the cover. In an embodiment the magnets 320, 330, 350, 360, 380, and 390 embedded in the board portion 410 as described above are adapted to allow for magnetic attachment of consumable material or items or small containers, for example individual pans, containing consumable material or items to the recesses 310. In an embodiment, for example, makeup pans manufactured from tin or other magnetic materials can be detachably attached within the recesses 310 via the force of magnetic attachment between one or more of the magnets 320, 330, 350, 360, 380, and 390 and the makeup pans.

Figure 13:
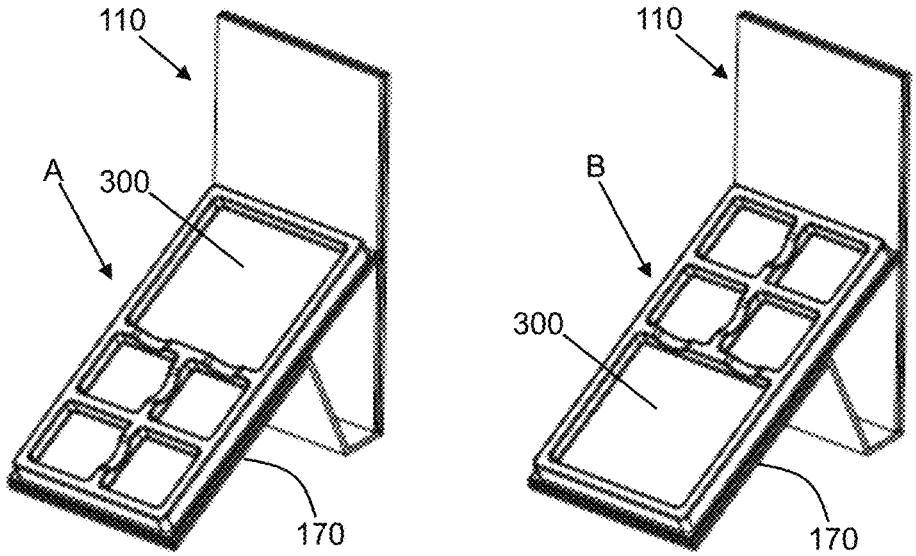
FIG. 13 illustrates detachable attachment of an exemplary receptacle tray to the exemplary cover in a first orientation, A, on the left and a second orientation, B, on the right according to an embodiment.

Referring to the left side of FIG. 13, in an embodiment the at least one receptacle tray 300 is adapted to detachably attach to the support portion 170 of the cover 110 in a first orientation, A, for example, via magnetic attraction between the magnets 240 and 250 (see FIG. 3) and the magnets 330 and 380 (see FIG. 6, respectively). Referring to the right side of FIG. 13, in an embodiment the at least one receptacle tray 300 is further adapted to detachably attach to the support portion 170 of the cover 110 in a second orientation, B, for example, via magnetic attraction between the magnets 240 and 250 (see FIG. 3) and the magnets 360 and 390 (see FIG. 6, respectively). In an embodiment, the first and second orientations A and B are relatively rotated by 180 degrees relative to the support portion 170.

Figure 14:
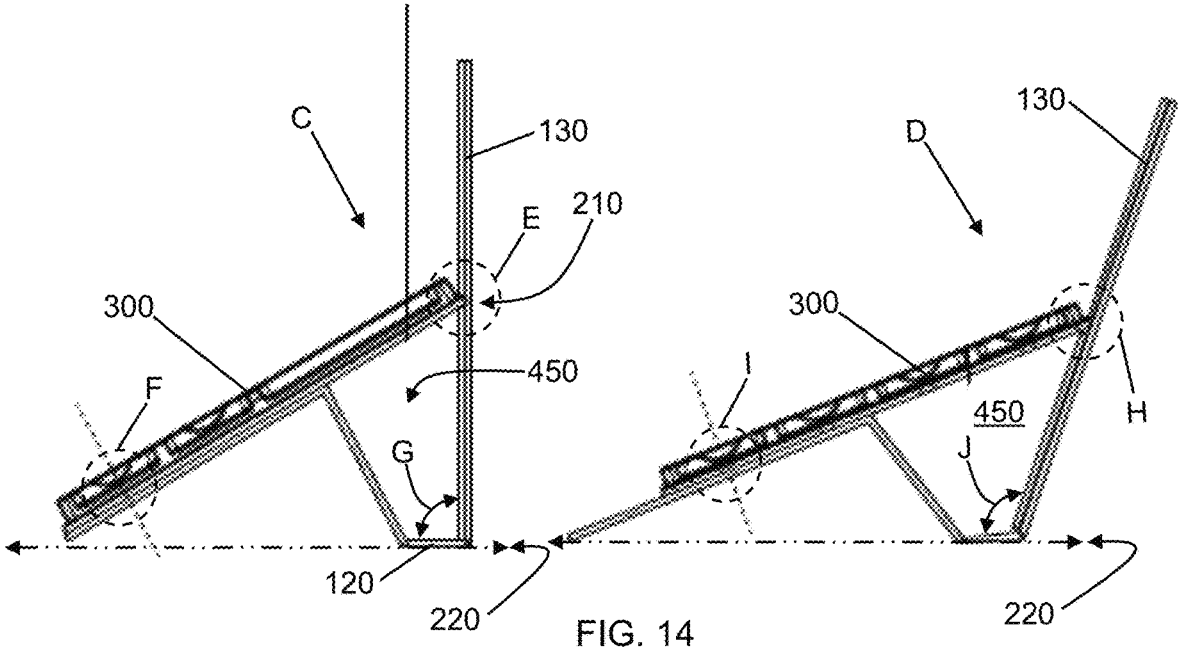
FIG. 14 illustrates detachable attachment of an exemplary receptacle tray to the exemplary cover in a first attachment, C, on the left and a second attachment, D, on the right according to an embodiment.

FIG. 14 illustrates the at least one receptacle tray 300 attached to the cover 110 in the second configuration in two different attachments, with the common plane 220 included as a reference. In an embodiment, on the left in FIG. 14, attachment C, illustrates the at least one receptacle tray 300 detachably attached to the cover 110 wherein an edge of the receptacle tray 300 detachably attaches within the easel docking groove 210 by magnetic attraction between the magnet 270 (see FIG. 3) disposed proximate to the easel docking groove 210 and one of the magnets 320 or 350 (see FIG. 6) within the dashed circle E, and also via magnetic attraction between one of the magnets 330 or 360 (see FIG. 6) and the magnet 240 (see FIG. 3) within the dashed circle F. In the attachment C, the top portion 130 of the cover 110 is disposed at an angle G relative to the hinge portion 120, where the angle G is essentially a right angle, and the at least one receptacle tray 300 is supported at an acute angle relative to the common plane 220.

In an embodiment, on the right in FIG. 14, attachment D, illustrates the at least one receptacle tray 300 detachably attached to the cover 110 by magnetic attraction between the magnet 270 (see FIG. 3) disposed proximate to the easel docking groove 210 and one of the magnets 320 or 350 (see FIG. 6) within the dashed circle H, and also via magnetic attraction between one of the magnets 330 or 360 (see FIG. 6) and the magnet 250 (see FIG. 3) within the dashed circle I. In the attachment D, the top portion 130 of the cover 110 is disposed at an angle J relative to the hinge portion 120, where the angle J is larger than a right angle, and where the at least one receptacle tray 300 is supported at an acute angle relative to the common plane 220.

Figure 15:
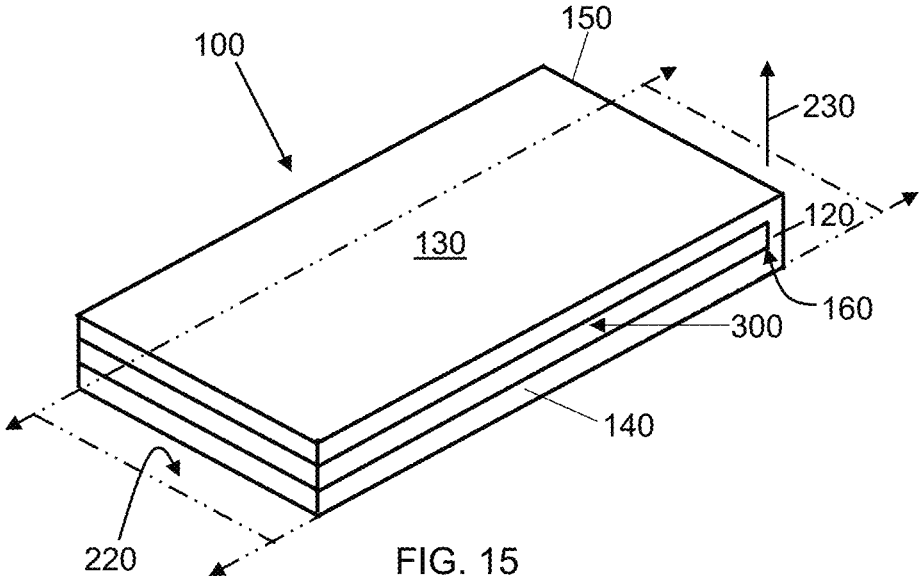
FIG. 15 illustrates detachable attachment of an exemplary receptacle tray to the exemplary cover in a third configuration according to an embodiment.

Referring to FIG. 15, the frame of reference utilized in FIG. 2 including the common plane 220, which is represented by the dashed rectangle, is utilized to describe a third configuration for the MPCS 100. In the third configuration the base portion 140 is disposed in the common plane 220, the hinge portion 120 is folded along the second fold line 160 in the first direction 230 away from the common plane 220, and the top portion 130 is disposed over the at least one receptacle tray 300 and generally parallel to the base portion 140.

Figure 16:
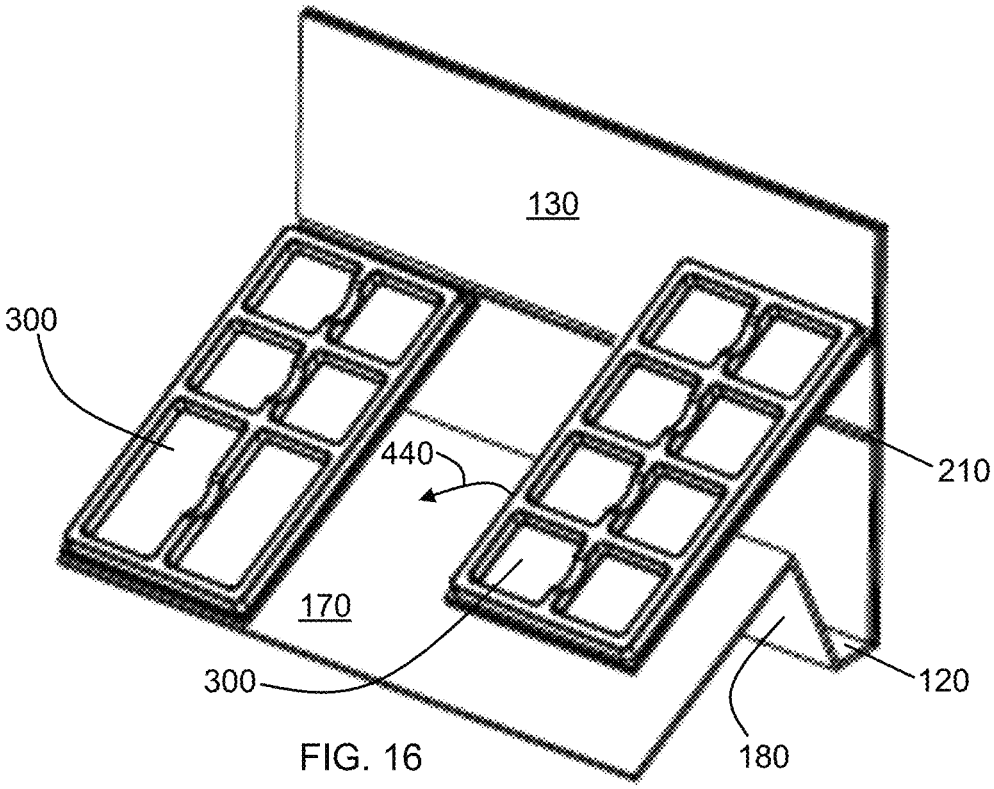
FIG. 16 illustrates two or more exemplary receptacle trays adapted to be detachably attachable to the exemplary cover according to an embodiment.

The length and width of the cover 110 can have a variety of aspect ratios as desired for functions or aesthetics. In an embodiment as illustrated in FIG. 16, the cover 110 has a wider appearance than that shown, for example, in FIG. 3. In an embodiment, the at least one detachable receptacle tray 300 comprises two or more detachable receptacle trays 300 that are adapted to be detachably attached side by side to the support portion 170. FIG. 16 illustrates a first receptacle tray 300 already attached to the support portion 170 and a second receptacle tray 300 being moved into attachment position as indicated by the arrow 440. In an embodiment when two or more receptacle trays 300 are attached to the cover 110, each of the two or more receptacle trays 300 attaches in all of the orientations and configurations and attachments as described hereinabove for a single receptacle tray 300.

As is visible in many of the FIGS., for example referring to FIG. 14, in an embodiment the cover 110 when supporting the one or more receptacle trays 300 in the second configuration provides a closed loop 450 that a user's finger can be inserted into to provide a secure and dexterous "midair" work station preventing product droppage.

In an embodiment at least a portion of the cover 110 or at least a portion of the at least one receptacle tray 300 is made from a biodegradable material selected from the group consisting of a biodegradable pulp, a biodegradable paper, a layer of biodegradable plastic film disposed over any of biodegradable pulp, biodegradable paper, or other substrate, tin, aluminum, biodegradable plastic, and combinations thereof. In an embodiment the at least one receptacle tray 300 comprises a first receptacle tray 300 that is disposable, and the cover 110 is reusable being adapted for use with at least a second receptacle tray 300 after being used with the first receptacle tray 300.

In an embodiment the cover 110 is manufactured as an inexpensive biodegradable throwaway; however, in another embodiment the cover 110 is manufactured as a high-end keepsake folio type piece that is reused/repurposed. In an embodiment the at least one receptacle tray 300 is adapted to contain consumable items, for example without limitation, makeup, and can be discarded after use, where replacement/refills trays 300 can be purchased separately and inserted into the previously purchased cover 110 minimizing waste and cost to the consumer.

INDUSTRIAL APPLICABILITY

A modular packaging container system as presented herein provides a convenient cover for supporting at least one receptacle tray that can have a myriad of recess configurations for holding consumer materials therein. The system conveniently supports the receptacle tray in multiple orientations and configurations for ease of access by a consumer. The modular packaging container system can be manufactured in industry for use by consumers.

Numerous modifications to the present invention will be apparent to those skilled in the art in view of the foregoing description. It is not desired to limit the invention to the exact construction and operation shown and described, and accordingly, all suitable modifications and equivalents may be resorted to, falling within the scope of the invention. Accordingly, this description is to be construed as illustrative only of the principles of the invention and is presented for the purpose of enabling those skilled in the art to make and use the invention and to teach the best mode of carrying out same. The exclusive rights to all modifications which come within the scope of the appended claims are reserved. All patents, patent publications and applications, and other references cited herein are incorporated by reference herein in their entirety.

We claim:

1. A modular packaging container system, comprising:

a cover comprising a hinge portion connected between a top portion and a base portion along first and second fold lines, respectively;

the base portion further comprising a support portion connected to an easel portion by a third fold line; and at least one receptacle tray;

wherein the support portion comprises first and second magnets embedded therein, wherein the first magnet is disposed between the second magnet and an edge of the support portion opposite the third fold line;

wherein in a first configuration the hinge portion, the top portion, and the base portion are all arranged within a common plane, and in a second configuration, the top portion is folded along the first fold line in a first direction away from the common plane, the third fold line is disposed away from the common plane in the first direction while the hinge portion remains in the same position as in the first configuration, and the at least one receptacle tray is detachably attached to the support portion in the second configuration.

2. The modular packaging system of claim 1, further comprising:

wherein the at least one receptacle tray is adapted to contain consumable items;

wherein the at least one receptacle tray comprises at least third and fourth magnets embedded therein, wherein the third magnet is disposed along a first edge of the at least one receptacle tray and the fourth magnet is spaced away from the third magnet;

wherein a first surface of the top portion further comprises an easel docking groove oriented parallel to the third fold line;

wherein the top portion further comprises a fifth magnet embedded therein proximate to the easel docking groove; and wherein the at least one receptacle tray is further adapted to detachably attach to the support portion via magnetic attraction between the fourth magnet and one of the first and second magnets, and the first edge is adapted to detachably attach to the easel docking groove in the second configuration via magnetic attraction between the third and fifth magnets to support the at least one receptacle tray at an acute angle relative to the common plane.

3. The modular packaging system of claim 2, wherein the at least one receptacle tray further comprises sixth and seventh magnets embedded therein, wherein the sixth magnet is disposed along a second edge of the at least one receptacle tray opposite the first edge and the seventh magnet is disposed between the third and fourth magnets so that the at least one receptacle tray is adapted to detachably attach to the support portion in a first orientation via magnetic attraction between the first or second magnet and the fourth magnet, and the at least one receptacle tray is further adapted to detachably attach to the support portion in a second orientation via magnetic attraction between the first or second magnet and the seventh magnet, wherein the first and second orientations are relatively rotated by 180 degrees relative to the support portion.

4. The modular packaging system of claim 3, wherein:

in the second configuration the at least one receptacle tray is detachably attached to the support portion via magnetic attraction between the first magnet and the fourth or seventh magnet.

5. The modular packaging system of claim 3, wherein in the second configuration the at least one receptacle tray is detachably attached to the support portion via magnetic attraction between the second magnet and the fourth or seventh magnet.

6. A modular packaging container system, comprising:

a cover comprising a hinge portion connected between a top portion and a base portion along first and second fold lines, respectively;

the base portion further comprising a support portion connected to an easel portion by a third fold line; and at least one receptacle tray comprising a tray portion separably attachable to a board portion;

wherein the support portion comprises first and second magnets embedded therein, each adapted to detachably attach the board portion of the at least one receptacle tray to the support portion, wherein the first magnet is disposed between the second magnet and an edge of the support portion opposite the third fold line;

wherein a first surface of the top portion further comprises an easel docking groove oriented parallel to the third fold line;

wherein in a first configuration the hinge portion, the top portion, and the base portion are all arranged within a common plane, and in a second configuration the top portion is folded along the first fold line in a first direction away from the common plane and the third fold line is disposed away from the common plane in the first direction while the hinge portion remains in the same position as in the first configuration.

7. The modular packaging system of claim 6, wherein:

the top portion further comprises a third magnet embedded therein proximate to the easel docking groove;

wherein the board portion of the at least one receptacle tray comprises at least fourth, fifth, sixth, and seventh magnets embedded therein, wherein the fourth magnet is disposed along a first edge of the board portion, the fifth magnet is spaced away from the fourth magnet, the sixth magnet is disposed along a second edge of the board portion opposite the first edge and the seventh magnet is disposed between the fourth and fifth magnets;

so that the board portion is adapted to detachably attach to the support portion in a first orientation via magnetic attraction between the first or second magnet and the fifth magnet, and the board portion is further adapted to detachably attach to the support portion in a second orientation via magnetic attraction between the first or second magnet and the seventh magnet, wherein the first and second orientations are relatively rotated by 180 degrees relative to the support portion.

8. The modular packaging system of claim 7, wherein:

in the second configuration the board portion is adapted to detachably attach to the support portion via magnetic attraction between the first magnet and the fifth or seventh magnet, or via magnetic attraction between the second magnet and the fifth or seventh magnet.

* * * * *